US005427435A

United States Patent [19]

Yoder, Jr.

[11] Patent Number: 5,427,435

[45] Date of Patent: Jun. 27, 1995

[54] CHAIR WITH ADJUSTABLE BACK SUPPORT

[76] Inventor: James H. Yoder, Jr., 1111 Daniels Church Rd., Lincolnton, N.C. 28092

[21] Appl. No.: 274,461

[22] Filed: Jul. 13, 1994

[51] Int. Cl.[6] ..... B60N 2/02; B60N 2/22

[52] U.S. Cl. ..... 297/377; 297/354.13; 297/440.24; 297/452.20

[58] Field of Search ..... 297/377, 354.13, 440.24, 297/452.20

[56] References Cited

U.S. PATENT DOCUMENTS

| | | | |
|---|---|---|---|
| 2,450,783 | 10/1942 | Collins | 297/377 |
| 4,583,758 | 4/1986 | Runion et al. | 297/440.24 |
| 4,641,837 | 2/1987 | Ruth | 297/377 |
| 4,945,587 | 8/1990 | Ferro | 297/377 |

*Primary Examiner*—Peter R. Crown
*Assistant Examiner*—Anthony Barfield
*Attorney, Agent, or Firm*—W. Thad Adams, III

[57] ABSTRACT

The invention is a chair with a seat and adjustable back support. The chair has a frame for carrying the seat and back support thereon. The frame includes a plurality of chair legs for locating the seat and back support above a supporting surface. A brace is rotatably mounted on a back end of the frame for engaging the back support to hold the back support in a fixed position relative to the seat. The brace is movable between a plurality of support positions for providing a plurality of respective recline angles, each of the recline angles being defined by the angle formed between the back support and the seat.

10 Claims, 4 Drawing Sheets

CHAIR WITH ADJUSTABLE BACK SUPPORT

TECHNICAL FIELD AND BACKGROUND OF THE INVENTION

This invention relates to a chair with an adjustable back support. The invention is light-weight, resists rust and sun damage, and is particularly useful outdoors when lounging at the beach, in the yard, or on the patio. The invention is assembled of easily removable and replaceable parts which are inexpensive and readily available for purchase by the owner. Thus, the owner can easily repair the chair when necessary, or easily and quickly custom-build a portion of the chair according to the invention to accommodate the particular size and weight of the user.

Many prior art chairs for use outdoors, such as common chaise lounges, include an adjustable back support which is often damaged or broken within a relatively short period of time. This damage typically results from rust, sun damage from UV exposure, accidents, or user abuse. When the back support is damaged or broken, the number of potential reclining positions is limited. Since the chair is not easily or conveniently repaired, the owner generally discards the damaged chair and buys a new one.

The present invention overcomes this problem of prior art chairs by providing a chair with an adjustable back support which is easily repaired when damaged. Moreover, because the components of the back support are easy to assemble and readily available, the owner can custom-build his or her chair to provide for movement between any desired degree of reclining angles.

SUMMARY OF THE INVENTION

Therefore, it is an object of the invention to provide a chair including an adjustable back support which is moveable between several reclining positions.

It is another object of the invention to provide a chair which is relatively easy to repair with relatively inexpensive and readily available parts.

It is another object of the invention to provide a chair which is relatively light-weight.

It is another object of the invention to provide a chair for use outdoors which resists rust and sun damage.

It is another object of the invention to provide a chair which is constructed of removable parts which may be readily interchanged with other like parts of various lengths for permitting the owner to custom build portions of the chair according to the particular needs and desires of the user.

It is another object of the invention to provide a chair including a supporting frame which is constructed primarily of PVC tube fittings.

It is another object of the invention to provide a chair including a supporting frame which is relatively quick and easy to assemble.

It is another object of the invention to provide a chair which is relatively inexpensive.

These and other objects of the present invention are achieved in the preferred embodiments disclosed below by providing a chair with a seat and adjustable back support. The chair includes a frame for carrying the seat and back support thereon. The frame includes a plurality of chair legs for locating the seat and back support above a supporting surface.

A brace is rotatably mounted on a back end of the frame for engaging the back support to hold the back support in a fixed position relative to the seat. The brace is movable between a plurality of support positions for providing a plurality of respective recline angles, each of the recline angles being defined by the angle formed between the back support and the seat.

According to one preferred embodiment of the invention, the back support includes a brace-receiving joint located on a back side thereof for being mated with a first end of the brace in a first support position to hold the back support at a first recline angle.

Preferably, the first recline angle is 135 degrees.

According to another preferred embodiment of the invention, the back support includes a second brace-receiving joint located on the back side thereof for being mated with a second end of the brace. Thus, the back support is held at second recline angle by rotating the brace to a second support position and mating the second end of the brace with the second brace-receiving joint.

Preferably, the second recline angle is between 110–115 degrees.

According to another preferred embodiment of the invention, the brace is movable to a third position for supporting the back support at a third recline angle 180 degrees relative to the seat.

According to yet another preferred embodiment of the invention, a handle is located at a top end of the back support to be gripped for moving the back support between the first, second, and third recline angles.

Preferably, the handle includes a removable and replaceable hollow PVC tube.

Preferably, the brace is a removable and replaceable hollow PVC tube.

According to another preferred embodiment of the invention, first and second removable and replaceable arms are connected to the frame, and located on opposite sides of the seat for supporting the arms of the user.

Preferably, the first and second arms are constructed of removable and replaceable hollow PVC tubes.

According to another preferred embodiment of the invention, the frame is constructed of a plurality of removable and replaceable hollow PVC tubes interconnected by a plurality of connecting joints.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
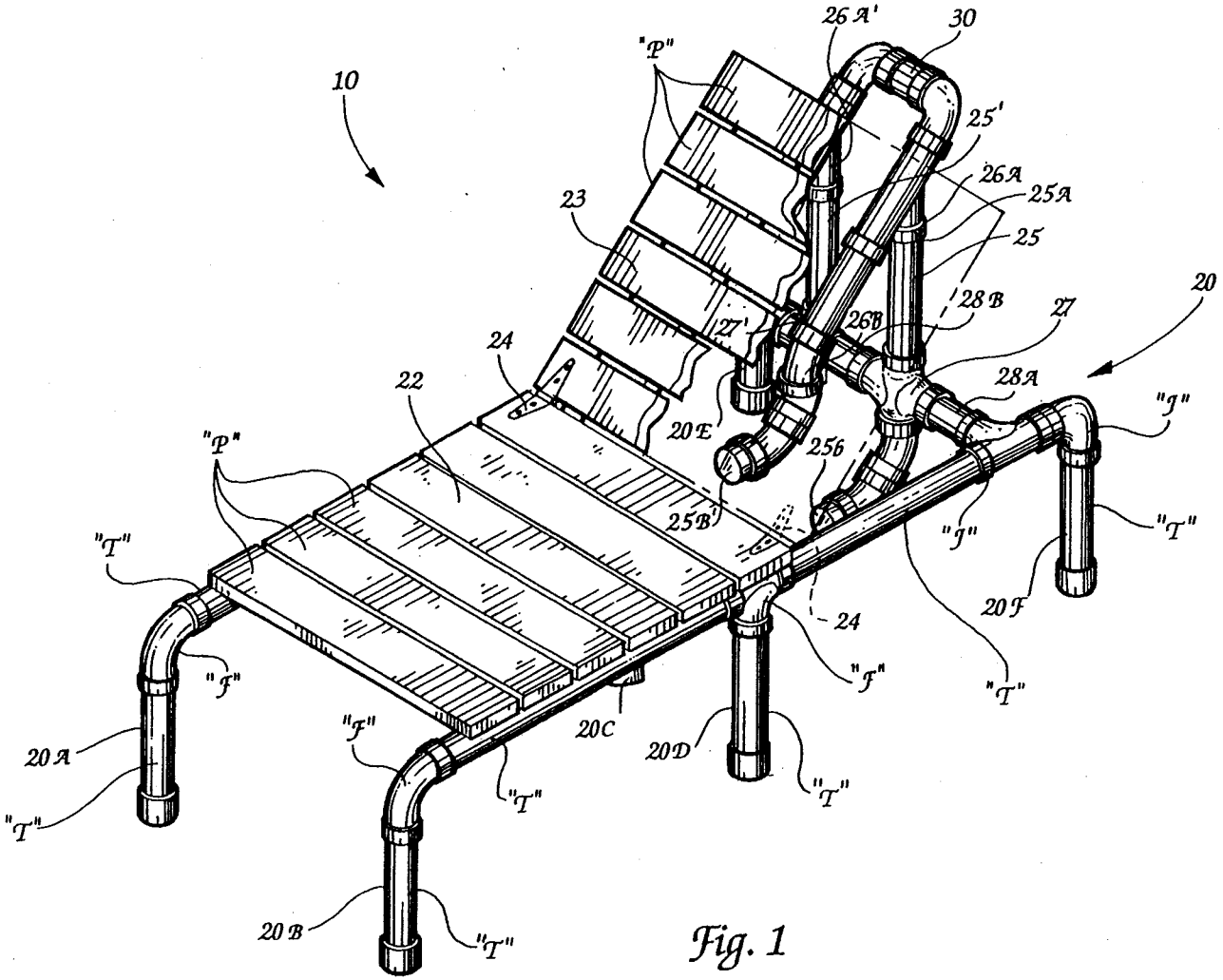
FIG. 1 is a perspective view of the invention according to a preferred embodiment with a portion of the back support broken away.

Referring now specifically to the drawings, a chair according to the present invention is illustrated in FIG. 1 and shown generally at reference numeral 10. The chair 10 has a frame 20 including a plurality of chair legs 20A–20F. A seat 22 and adjustable back support 23 are carried by the frame 20. Preferably, the seat 22 and back support 23 are connected together by hinges 24. According to one embodiment, the seat 22 and back support 23 are each constructed of 4×1 inch wooden planks "P". Alternatively, the seat 22 and back support 23 are formed of tinted Plexiglas with a UV stabilizer.

The frame 20 is an assembly of hollow tubes "T" formed of a light-weight plastic. Preferably, the tubes "T" are 1½-inch diameter PVC tubing, such as that commonly used for plumbing fixtures. The tubes "T" are interconnected by a plurality of connecting joints "J". Each of the tubes "T" and connecting joints "J" are readily removable and replaceable when worn or damaged.

As best shown in FIG. 1, a brace 25 having first and second ends 25A and 25B is rotatably mounted for 360 degree rotation on the back end of the frame 20 to engage the back support 23, and to hold the back support 23 in one of three fixed positions relative to the seat 22. Preferably, the brace 25 is constructed of 1½-inch diameter PVC tubing.

Upper and lower brace-receiving joints 26A and 26B are located on the back side of the back support 23 for mating with one of the first and second ends 25A and 25B of the brace 25. Preferably, the chair 10 includes two braces 25 and 25' and two sets of brace-receiving joints 26A, 26B and 26A', 26B' for providing added support and stability. The elements indicated in prime notation 25', 26A' and 26B' are identical to the corresponding elements 25, 26A and 26B.

Figure 5:
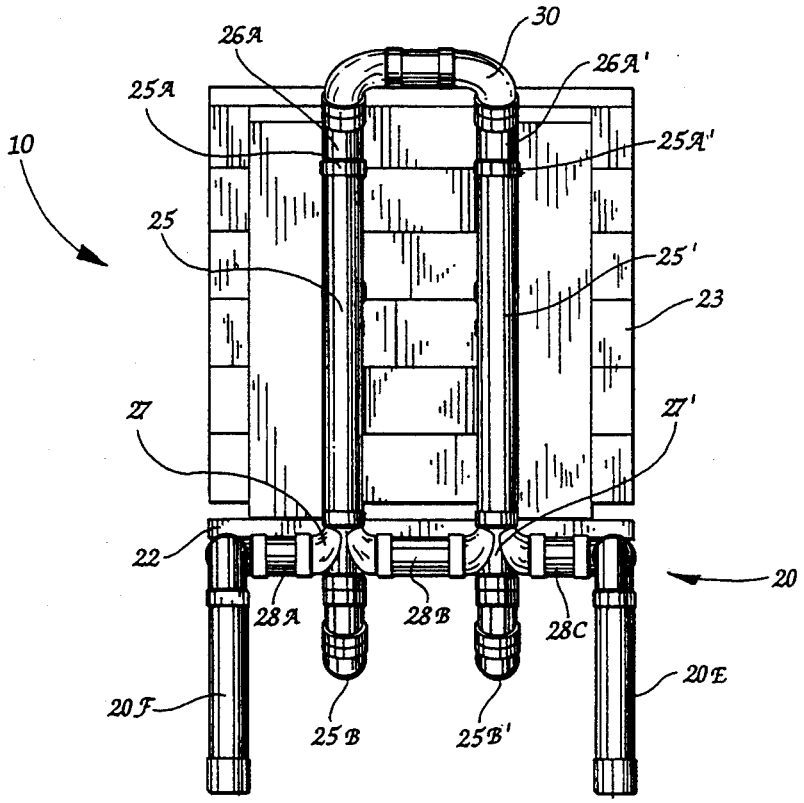
FIG. 5 is a back elevation of the invention with the back support positioned at the first recline angle.

Preferably, the braces 25 and 25' include respective pivot joints 27 and 27' carried by cross-support tubes 28A, 28B, and 28C extending, collectively, from one side of the frame 20 to the other side of the frame 20 (See FIG. 5). The connection between the pivot joints 27, 27' and cross-support tubes 28A–28C provides for rotational movement of the braces 25 and 25' about an axis defined by the cross-support tubes 28A–28C.

Referring now to FIGS. 2–5, the description of the chair 10 will continue below with reference to the brace 25 and brace-receiving joints 26A and 26B. Like elements relating to the brace 25' and shown in FIGS. 2–5 will be indicated with prime notation.

The three alternate positions of the back support 23 form respective recline angles which may be adjusted by the user, as desired, by moving the brace 25 between the first, second, and third support positions. The recline angle is defined as the angle formed between the back support 23 and the seat 22. The chair 10 with the back support 23 positioned at the first, second, and third recline angles is shown, respectively, in FIGS. 2–5.

Figure 2:
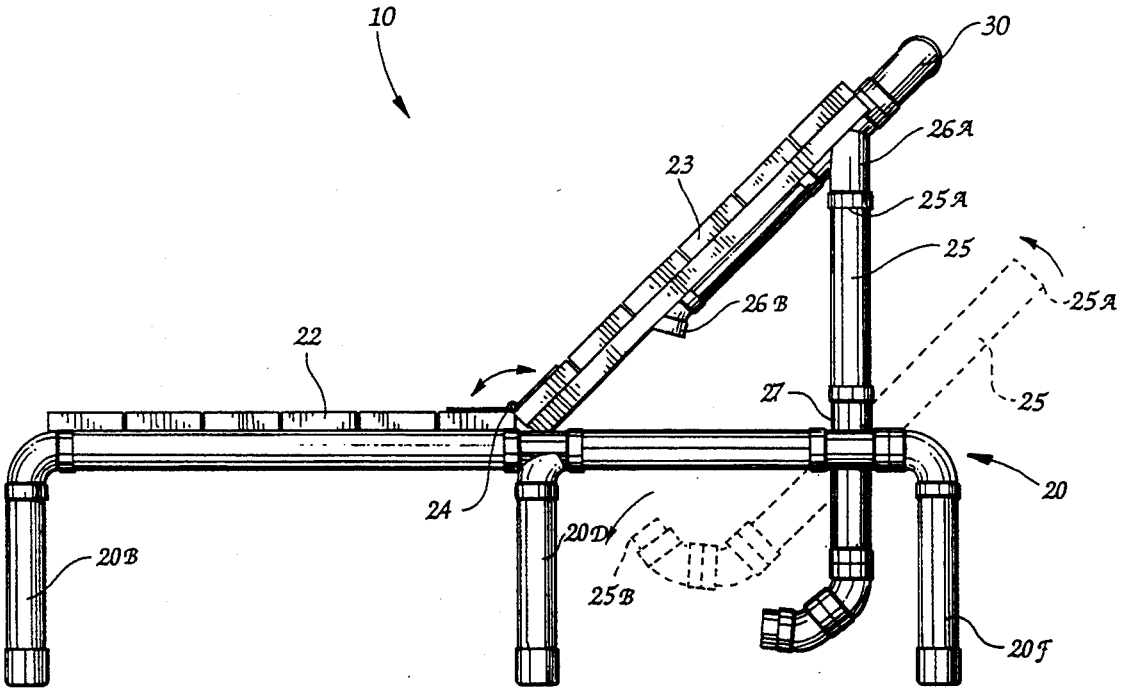
FIG. 2 is a side elevation of the invention according to a preferred embodiment with the back support positioned at a first recline angle.

As shown in FIG. 2, the back support 23 is held at the first recline angle with the brace 25 in the first support position generally perpendicular to the plane surface of the seat 22. Preferably, the first recline angle is approximately 135 degrees. To achieve this position, the brace 25 is rotated about the cross-support tubes 28A–C to align and mate the first end 25A of the brace 25 with the upper brace-receiving joint 26A.

Figure 3:
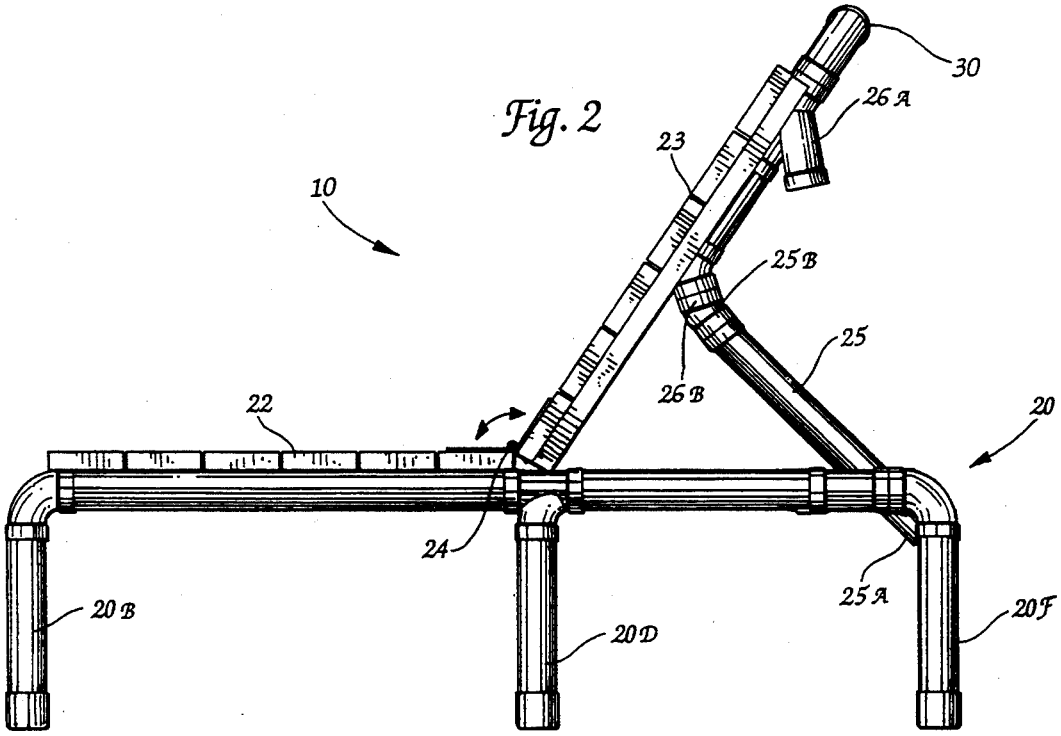
FIG. 3 is a side elevation of the invention according to a preferred embodiment with the back support positioned at a second recline angle.

FIG. 3 illustrates the back support 23 at the second recline angle with the brace 25 in the second support position. In the second support position, the first end 25A of the brace 25 extends outwardly, away from the seat 22 and in substantial alignment with the plane surface of the seat 22. Preferably, the second recline angle is approximately 110–115 degrees. To achieve this position, the brace 25 is rotated about the cross-support tubes 28A–C to align and mate the second end 25B of the brace 25 with the lower brace-receiving joint 26B.

Figure 4:
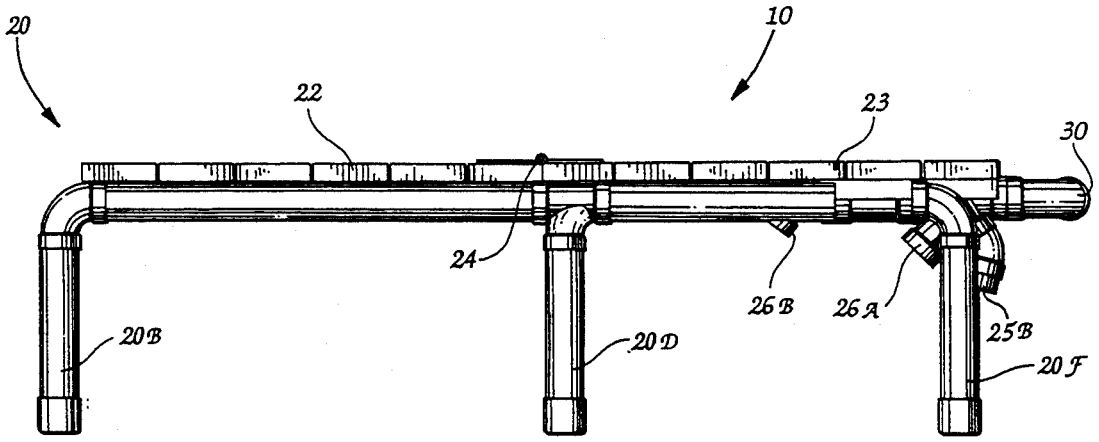
FIG. 4 is a side elevation of the invention according to a preferred embodiment with the back support positioned at a third recline angle.

FIG. 4 illustrates the back support 23 at the third recline angle with the brace 25 in the third support position. In the third support position, the first end 25A of the brace 25 preferably extends inwardly towards the seat 22 and in substantial alignment with the plane surface of the seat 22. Preferably, the third recline angle is approximately 180 degrees. To achieve this position, the brace 25 is detached from the upper or lower brace-receiving joint 26A and 26B, and the back support 23 is lowered to rest freely on the cross-support tubes 28A–C.

In addition, the chair 10 preferably includes a handle 30 located at the top end of the back support 23 for being gripped by the user to move the back support 23 between the first, second, and third relining angles shown in FIGS. 2–5. Preferably, the handle is formed of 1½-inch diameter PVC tubing, and is connected at respective ends thereof to each of the upper brace-receiving joints 26A and 26A'. The handle is removable and replaceable when worn or damaged.

Figure 6:
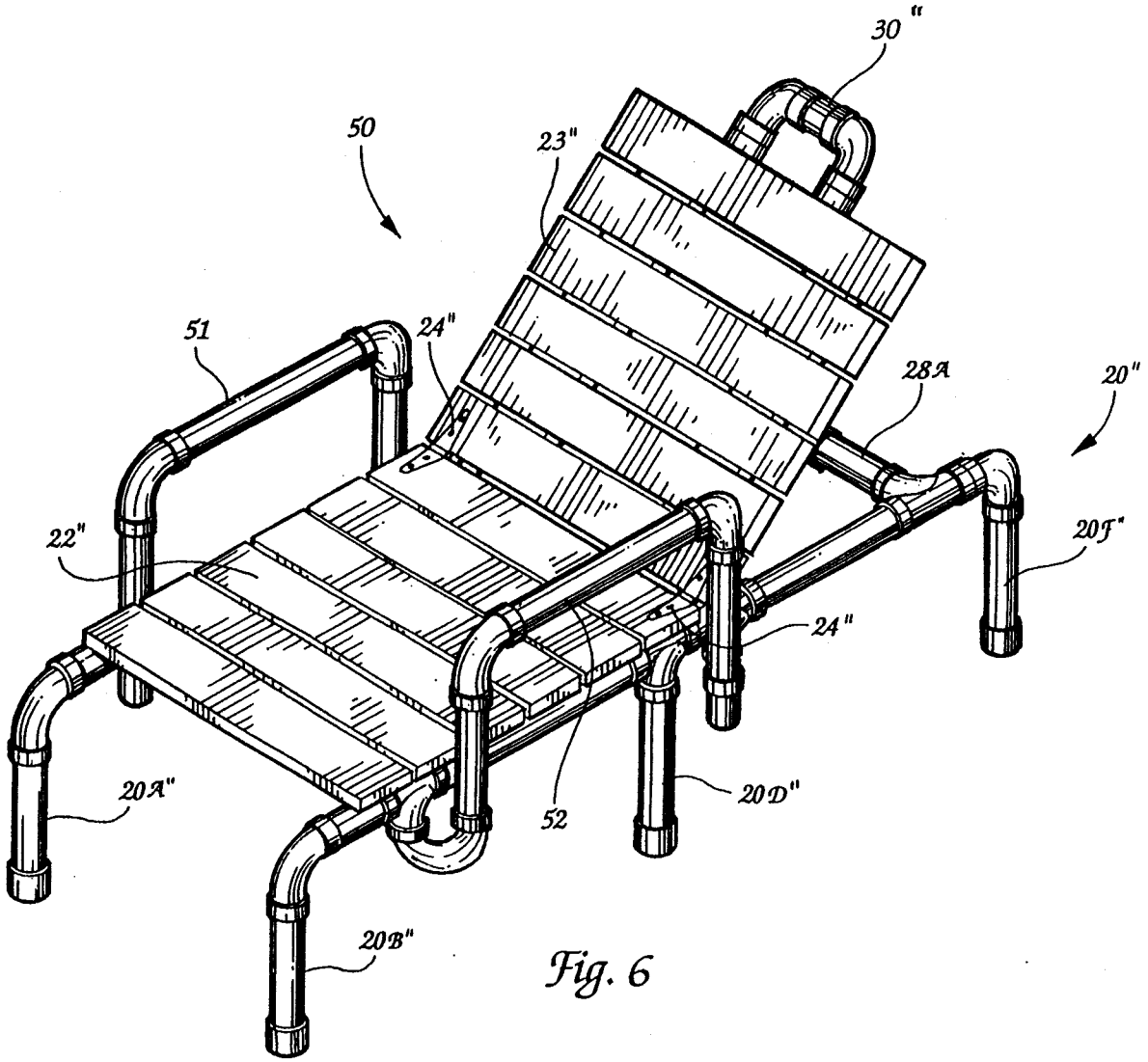
FIG. 6 is a perspective view of the invention according to a second preferred embodiment.

A second embodiment of the invention is illustrated in FIG. 6. Like elements shown and described with reference to the chair 10 of FIGS. 1–5 are indicated in double prime notation. As shown, the chair 50 includes removable arms 51 and 52 located on respective sides of the seat 22 for supporting the arms of the user when in a lounging or seated position. Preferably, each of the arms 51 and 52 are constructed of 1½-inch diameter PVC tubing.

In addition, the pitch and location of the upper and lower brace-receiving joints, the brace, and the tubes "T" of the chairs 10 and 50 may be varied to create a custom chair of any desired size, and including a back support movable between any number of desired reclining angles. To accomplish this, each of the elements of the chairs 10 and 50 may be easily replaced with similar elements of greater or lesser dimensions.

A chair with an adjustable back support is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. A chair with a seat and adjustable back support, said chair comprising:

(a) a frame for carrying the seat and back support thereon, and including a plurality of chair legs for locating the seat and back support above a supporting surface;

(b) a brace rotatably mounted on a back end of said frame for engaging the back support to hold the back support in a fixed position relative to the seat, said brace being movable between a plurality of support positions for providing a plurality of respective recline angles, each of said recline angles being defined by the angle formed between the back support and the seat;

(c) a first brace-receiving joint located on a back side of the back support for being mated with a first end of said brace in a first support position to hold the back support at a first recline angle; and (d) a second brace-receiving joint located on the back side of the back support and spaced-apart from said first brace-receiving joint for being mated with a second end of said brace, whereby the back support is held at second recline angle by rotating said brace to a second support position and mating the second end of said brace with the second brace-receiving joint.

2. A chair according to claim 1, wherein the first recline angle is 135 degrees.

3. A chair according to claim 1, wherein the second recline angle is between 110–115 degrees.

4. A chair according to claim 1, wherein said brace is movable to a third position for supporting the back support at a third recline angle 180 degrees relative to the seat.

5. A chair according to claim 4, and including a handle located at a top end of the back support to be gripped for moving the back support between the first, second, and third recline angles.

6. A chair according to claim 5, wherein said handle comprises a hollow PVC tube.

7. A chair according to claim 1, wherein said brace comprises a hollow PVC tube.

8. A chair according to claim 1, and including first and second removable and replaceable arms connected to said frame and located on opposite sides of the seat for supporting the arms of the user.

9. A chair according to claim 8, wherein said first and second arms are constructed of removable and replaceable hollow PVC tubes.

10. A chair according to claim 1, wherein said frame is constructed of a plurality of removable and replaceable hollow PVC tubes interconnected by a plurality of connecting joints.

* * * * *